US005864305A

United States Patent [19]

Rosenquist

[11] Patent Number: 5,864,305

[45] Date of Patent: Jan. 26, 1999

[54] TRAFFIC INFORMATION SYSTEM

[75] Inventor: Mats Rosenquist, Göteborg, Sweden

[73] Assignee: AB Volvo, Göteborg, Sweden

[21] Appl. No.: 704,627

[22] PCT Filed: Mar. 3, 1995

[86] PCT No.: PCT/SE95/00224

§ 371 Date: Nov. 7, 1996

§ 102(e) Date: Nov. 7, 1996

[87] PCT Pub. No.: WO95/24029

PCT Pub. Date: Sep. 8, 1995

[30] Foreign Application Priority Data

Mar. 4, 1994 [SE] Sweden ..... 9400750

[51] Int. Cl.[6] ..... G08G 1/09

[52] U.S. Cl. ..... 340/905; 340/990; 340/995; 701/208; 701/212

[58] Field of Search ..... 340/990, 995, 340/988, 993, 905; 364/449.1, 449.2, 449.6; 701/200, 207, 208, 209, 212, 213

[56] References Cited

U.S. PATENT DOCUMENTS

| | | | |
|---|---|---|---|
| 3,949,401 | 4/1976 | Hegeler et al. | 455/526 |
| 4,380,821 | 4/1983 | Eckhardt | 528/388 |
| 4,409,583 | 10/1983 | Dahan et al. | 340/995 |
| 5,095,532 | 3/1992 | Mardus | 455/186.1 |
| 5,193,214 | 3/1993 | Mardus et al. | 455/186.1 |
| 5,257,023 | 10/1993 | Furuya | 340/995 |
| 5,293,163 | 3/1994 | Kakihara et al. | 340/995 |
| 5,614,895 | 3/1997 | Ohomori et al. | 340/995 |
| 5,652,706 | 7/1997 | Morimoto et al. | 364/449.4 |
| 5,652,707 | 7/1997 | Wortham | 364/460 |
| 5,682,133 | 10/1997 | Johnson et al. | 340/426 |
| 5,696,684 | 12/1997 | Ueberschaer | 340/990 |

FOREIGN PATENT DOCUMENTS

| | | |
|---|---|---|
| 478 438 | 4/1992 | European Pat. Off. . |
| 29 19 664 | 11/1980 | Germany . |
| 41 18 606 | 12/1991 | Germany . |
| 43 21 437 | 2/1994 | Germany . |
| 2 050 767 | 1/1981 | United Kingdom . |

*Primary Examiner*—Jeffery A. Hofsass
*Assistant Examiner*—Ashok Mannava
*Attorney, Agent, or Firm*—Burns, Doane, Swecker & Mathis, L.L.P.

[57] ABSTRACT

A traffic information system for receiving, selecting and presenting relevant traffic information to a user allows the kind and amount of presented information to be defined subjectively by a user. At least part of the information is optional with different detail levels relating to a range of most basic information to most detailed information. The information are subjectively defined via a programable filtering function through which a filter can be defined or programmed to select a detail level of the basic information.

20 Claims, 8 Drawing Sheets

FIG. 4

| SYMBOL | COLOR | INDICATES |
|---|---|---|
| | RED | STATIONARY TRAFFIC |
| | YELLOW | INCIDENT |
| | RED | MOVING TAILBACK TWO WAY |
| | RED | MOVING TAILBACK ONE WAY |
| | YELLOW | SLOW TRAFFIC TWO WAY |
| | YELLOW | SLOW TRAFFIC ONE WAY |
| | YELLOW | INFORMATION AVAILABLE |
| | RED | REGIONAL MASSAGE AVAILABLE |
| | YELLOW | REGIONAL MASSAGE AVAILABLE |

TRAFFIC INFORMATION SYSTEM

FIELD OF THE INVENTION

The present invention relates to a traffic information system according to the first part of claim one. Traffic information systems are becoming more and more interesting among others due to the increasing number of vehicles on the roads. Due to the increasing traffic on the roads the situation is that it sometimes—or even often—takes too much time to get from one point to another because of hindrances such as queues, accidents, road construction works etc. Neither hindrances simply because of too much traffic nor hindrances of the more accidental or coincidental character can really be avoided or reduced as to their effects with any other means than through the creation of traffic surveying traffic information systems with the help of which it is really possible to, in time, get information about the situation along the possible route a particular driver may take. This is of a great importance both for reasons of saving time and for avoiding queues which is a secondary effect that positively affects the environment as well as it increases the safety both as far as primary dangers are concerned, such as e.g. animals on the road, a slippery road or similar and secondary dangers, i.e. in the form of an accident which already has taken place but which might cause further accidents etc.

Consequently it is of the utmost importance, with the increasingly busy and complex road traffic, that traffic information systems are provided wherein the quality of the traffic information is high and without undue delay of the transmission to the relevant user to whom the information must be easily accessible etc.

STATE OF THE ART

Traffic information can e.g. be provided via traffic announcements made by radio broadcasting stations. The provision of information is improved through the use of e.g. the German ARI-system, and the European standard RDS, Radio Data System. At the option of the driver, the car-radio will automatically pick up the traffic announcements and turn up the loudspeaker volume or shut off the cassette player at the occurrence of a signal which is given by the broadcaster. The normal radio emissions are in this case interrupted to provide the driver with the relevant traffic information. In this case, however, the traffic announcements are made over the normal audiochannel. This means that anyone who has tuned into that particular frequency will hear the information even if he is not concerned. However, generally the broadcaster will not permit the programs to be interrupted to such a large extent or as frequently as it might be necessary in some instances since this would make the program uninteresting to the listeners who are not concerned. Furthermore the driver might not even be in the car when the information is delivered and then might already have chosen the road where the hindrance is located before the message is delivered the next time.

Furthermore it is not possible for the driver to get an overview of the current situation e.g. before entering an area etc.

With for example the Radio Data System (RDS), information can be broadcast digitally using the existing FM network. The digital information is transmitted without causing any disturbance in the audio channel through using spare frequency space available in the FM bands. The RDS thus provides a silent, digital channel which can be added to any FM radio station. At the user end an RDS demodulator and a decoder has to be added to the FM-receiver. However, as already mentioned, when the traffic announcements are picked up by the RDS car radio, the normal programs are interrupted.

However, the traffic message channel (TMC) uses the FM subcarrier channel for broadcasting coded messages describing the traffic event in full detail. Thus, with the RDS/TMC it is possible to transmit traffic information without interfering at all with the normal audio channel. The traffic message channel TMC uses the FM subcarrier channel for broadcasting coded messages which describe the traffic events in a detailed manner. A TMC protocol called ALERT-C was proposed as a European standard and it was developed in the RDS-consortium in the EU research program DRIVE. ALERT-C specifies messages which can be coded and input at the traffic information center, broadcast over an FM network and finally decoded and presented to the user. It has however been difficult to find the appropriate user—interface. Both text based and voice based versions of mobile equipment for presentation have been tried, however without really being successful and achieving the desired results.

In e.g. EP-A-0 478 438 a receiver is shown which is intended to assist in car navigation. Via a radio receiver coded messages are received. In a storage a number of data relating to maps and localisations of problems are stored. The receiver comprises means for decoding the received messages as well as means for giving them a form which is accessible to the user. The storage stores pixels which represent maps. The receiver further comprises presentation means and means for grafically illustrating the localisations of the problem messages on a display. The last means are intended to give that part of the road where the problem is present a different colour by exchanging the pixels in that area through pixels of another colour. However, with this kind of device the information presented as well as the basic information, both as far as quantity as quality is concerned, will be limited.

SUMMARY OF THE INVENTION

It is an object of the present invention to provide a traffic information system for receiving, selecting and presenting the relevant traffic information in the right time to a user. It is a further object with the invention to provide a system which is easy to use, i.e. that is user-friendly. Still another object of the invention is to provide a system with a high quality of the information which describes the situation as accurately as necessary or as desired. Still another object of the invention is to provide a system which in no way impairs traffic safety due to a complicated handling thereof etc. A further object of the invention is to provide a traffic information system that can be used universally. Another object of invention is to provide a traffic information system which is adaptable to the users needs as to location but also as to any other need. Still a further object of the invention is to provide a system which is flexible and wherein the kind and amount of information provided to a great extent can be defined by the user. Another object of invention is to provide a system which is cheap and easy to fabricate and wherein the storage capacity does not limit its informative capacity.

According to an advantageous embodiment the means for presentation is a graphical display. According to one embodiment it is a colour display although this is not necessary. Particularly, the basic information stored on a memory card comprises a limited number of maps. Thus the user has the option to choose the appropriate card covering e.g. the area or the region he is interested in. Even more particularly the location codes are stored on a memory card. More particularly even, the memory card comprises the traffic messages (e.g. the TMC-messages) and the languages stored thereon. In a particularly advantageous embodiment, symbols or icons and/or traffic signs are stored on the card. In a further particularly advantageous embodiment all basic or background user and area dependent information is stored on the memory card, i.e. the fixed information whereas the actual or temporary user and area dependent information is stored in a user programmable memory in the receiver station.

According to a preferable embodiment a number of different information levels or display levels can be displayed. This means particularly that the user can select the level of information he wants, either generally or in a particular case. Even more special, at least two, preferably at least three different levels of information can be selected, the levels of information being e.g. symbols, signs, text. This means particularly that the user can choose between those three different levels wherein symbols relate to the most basic degree of information, the signs bringing somewhat more detailed information and the text information being the most detailed information. In this case, it is possible to set the access to the levels respectively in such a way that e.g. the most detailed level of information, the text information, is only available, in case of a movable vehicle, when the car or similar is stopped for reasons of safety in the traffic. Of course this does not apply to the case wherein the receiving station is a fixed station. Also in case of a moving receiving station it is not mandatory, if so desired it is also possible to enter the text mode, i.e. display text information when the receiving station is moving.

According to an advantageous embodiment remote control means are used for selecting the desired information or display level as well as for zooming in on the map or similar. Of course other means than remote control means can of course be used for the different functions, e.g. fixedly arranged means on the receiver station or elsewhere, this merely giving one example. The remote control is also used to set the desired level of information, i.e. the level of information that is or can be automatically shown on the display upon activation although this is not necessary. More particularly even, the different information or display levels, i.e. what they comprise can be defined or programmed by the user for his personal needs, via the remote control (or any other means).

According to a further embodiment, it is possible to select between at least two different palettes e.g. a night and a day palette and/or one normal palette and one for colour blind persons etc. The former is due to the fact that a very bright palette can have a light intensity and a colour which is too strong at night and therefore has a negative influence on e.g. the driver.

According to a particularly advantageous embodiment the system is linked to the Global Positioning System (GPS) or to any other positioning system wherethrough both traffic information and information on the position of the moving vehicle is displayed at the same time. In a particular embodiment the receiving station is mounted in a car, bus, truck or similar, i.e. a moving vehicle whereas according to another embodiment the receiving station is fixed.

BRIEF DESCRIPTION OF THE DRAWINGS

The invention will in the following be described in relation to the accompanying drawings in an explanatory and by no means limiting way, wherein.

DETAILED DESCRIPTION OF THE INVENTION

Figure 1:
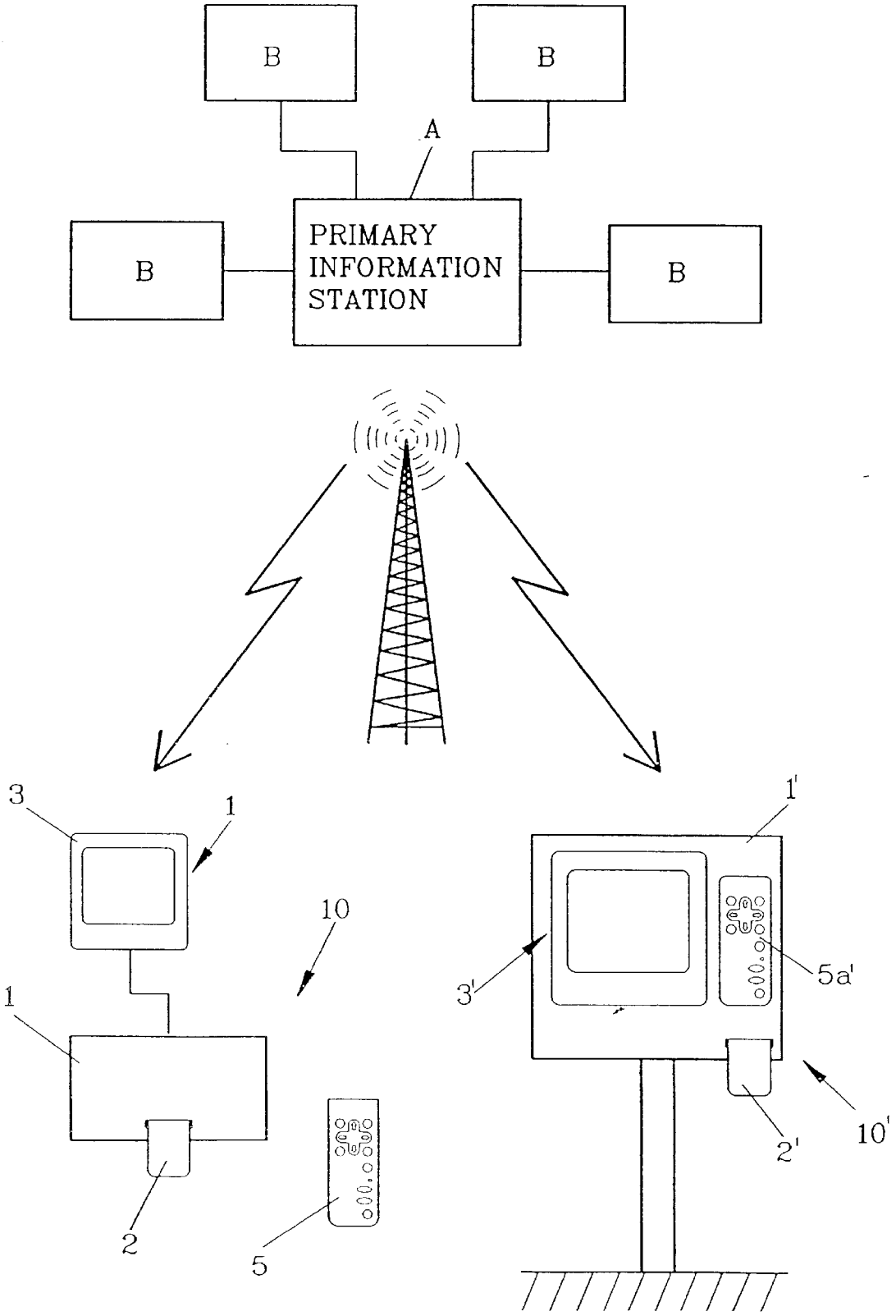
FIG. 1 illustrates an overview of a system with a movable and a fixed receiving station respectively according to the invention.
Figure 2:
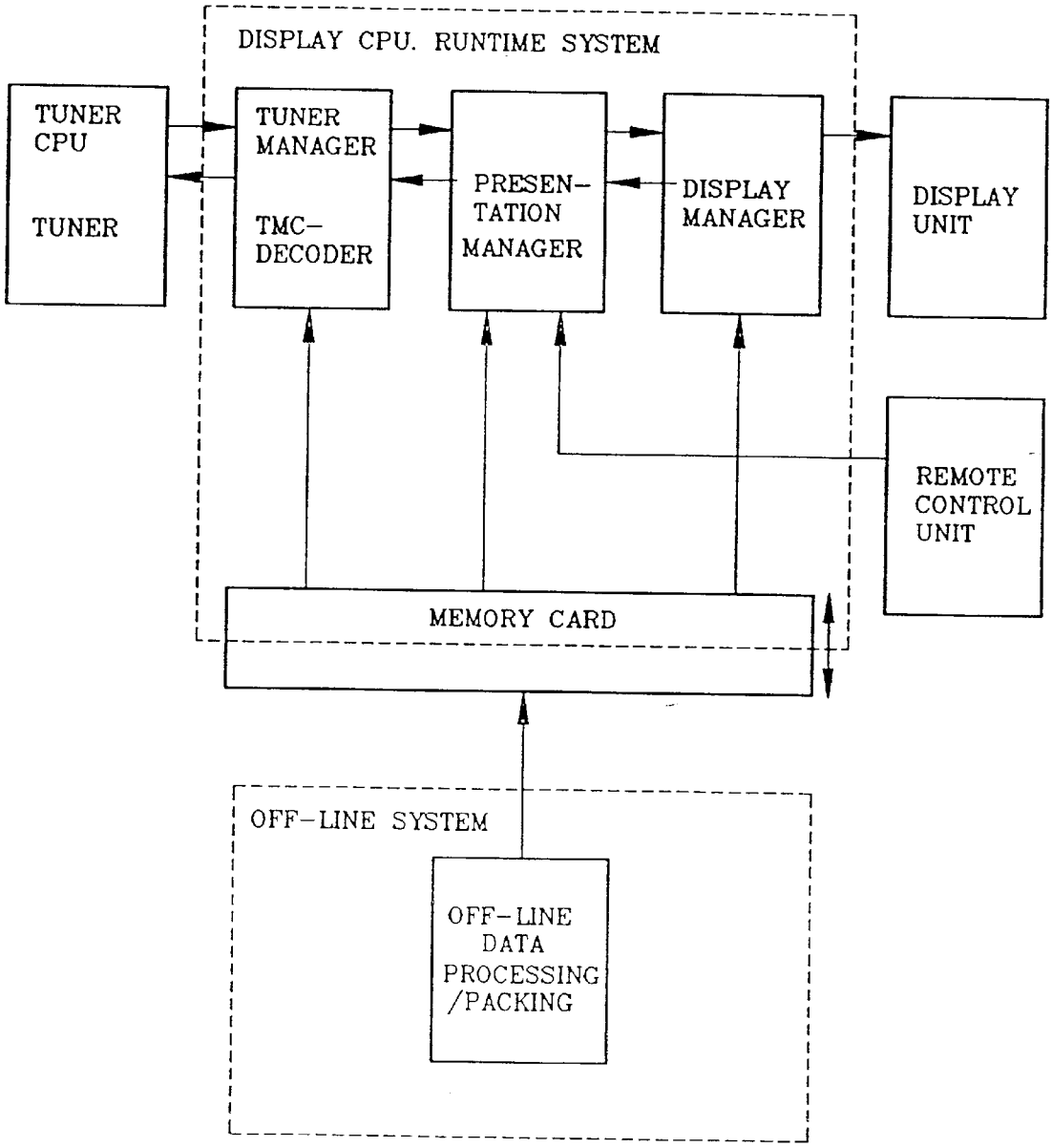
FIG. 2 illustrates a block diagram of the receiving arrangement, FIGS. 3*a*–3*c* schematically illustrate different levels of information as shown on the display, FIG. 4 gives an example of the symbol language.

In FIG. 1 two kinds of traffic information systems are illustrated, namely one with a movable receiving station 10 and one with a fixed receiving station 10'. Traffic information is collected in the primary traffic information station A. The primary information station A receives information from a number of a secondary information means or stations B. The secondary information means B can be of a number of different kinds and examples thereof are emergency centers and police centers respectively, both of this category having their own reporting channels to the traffic information center A. Local radio stations B give messages to the information center A e.g. in an automatic manner and generally it is also provided for private individuals to provide the information center A directly with information. A further category of secondary information means B are weather stations which may issue e.g. reports on air and road surface temperatures, wind conditions, rain, snow etc. at regular time intervals. Another category is sensors which are located in the roads e.g. forming a network to register information such as e.g. the number of passing vehicles, average distance between vehicles and the average speed etc. As soon as a traffic flow deviates from a determined normal state, a signal is transmitted to the traffic information center A. There are also other information sources B such as different departments reporting on roadworks and diversions, parking companies providing parking-situation information, as well as taxis and other fleet vehicles on the road. Every kind of information providing means B can of course be used for providing the information that is needed and relevant. Advantageously the traffic information center A selects the information which is to be transmitted or at least makes a first selection. However, in alternative embodiments the traffic informations center A does not necessarily carry out a selective process. The information is coded and messages are sent out using e.g. the normal FM transmitters to receiving stations 1 which may be arranged in moving vehicles but which also may take the form of fixed stations 1', e.g. in form of stationary information boards or similar. Under normal circumstances is only local information broadcast within the transmitters area. If however the information is of more global or general interest, it is broadcast using several transmitters. This kinds of messages can be provided nationwide or even on the international level. In the receiving arrangement 10;10' the information is decoded and processed into the language which is required. The basic information or the background information such as e.g. maps of the particular region etc. is contained on a memory card 2;2'. These memory cards 2;2' are exchangeable and the user can decide which memory card 2 is the appropriate one to use during a journey, part of the journey or in a region etc. There are thus a number of different memory cards 2;2' available to the user. Through the use of the card, the system can be used universally. The memory card can either be connected directly to the receiving station (c.f. FIG. 2) or via a separate card reading device (not shown). The information messages are transmitted via a digital radiocommunication system. In the following a particular embodiment will be described wherein RDS/TMC is used, but this is of course merely given as an example, any digital radiocommunication system can be used. Furthermore, the invention is of course not limited to the TMC protocol; on the contrary it is independent of protocol and transmitting frequency and modulation method.

As mentioned in the foregoing, RDS/TMC is one way of transmitting digitally coded traffic information messages over the Radio Data System channel using ordinary FM transmitters. As already mentioned, the digital information is transmitted without causing any disturbance in the audio channel since it uses spare frequency space that is available in the FM band. The receiving arrangement receives, collects and presents the traffic information via the RDS/TMC channel. The receiving arrangement 10;10' comprises demodulating means and decoding means which are arranged in the receiver station 1;1'. The receiving station 1;1' comprises a graphic, colour display 3;3' for graphically presenting the RDS/TMC messages to the driver etc. e.g. by means of symbols, signs and text. As already mentioned, it does of course not have to be a colour display. The TMC protocol (the ALERT-C) as already mentioned specifies messages which can be coded and input at the traffic information center A, broadcast over an FM network and then decoded and presented at the receiving station 1;1' which may be moveable 1 or fixed 1'. The initial level of TMC messages comprises explicit broadcast information such as event description, i.e. details of the disturbance etc, location of the disturbance or incident, its extent wherein adjacent areas are identified but also segments or specific point locations which also are, or may be, affected, the duration or the expected duration of the disturbance and finally a diversion advice as to whether drivers are recommended to avoid the area or not. With an efficient coding of the information as related to above which relates to one event, can the messages be sent using only 37 bits. It is generally advantageous to use the TMC for transmitting the information since the information can be broadcast inaudibly using infrastructure equipment that is already in place, the coded messages provide for an intelligent receiver processing of the information before it is presented to the driver and since the message list is coded and common to a given region such as, e.g. all Europe or U.S.A. etc, the messages can always be presented in the, by the user, preferred language. However, it is not necessary to use TMC, other alternatives also being possible as already mentioned above. The traffic information is advantageously transmitted in a digital format. In the exemplified embodiment the ALERT-C protocol (already referred to above) is used to encode the traffic information. With the use of this protocol, the information can be encoded in a dense way which is advantageous. Locations may e.g. relate to continents, countries, regions, cities, main roads, roadsegments or point locations. The location data is stored both at the transmitter and the receiver end. Each location corresponds to a record which can be adressed by the location code, i.e. by merely including the location code in the message, full location information is given. A record contains information such as a set of characters which, in the language chosen by the user, describe the location, give references to higher level locations, references to positive and negative offset locations, i.e. references to locations at the same level and location classification wherein the location may be classified as being e.g. a region, a city, a motorway, a bridge or a tunnel and so on.

After the reception and the decoding of the TMC messages, they are to be forwarded to the user. The presentation of the information is of great importance since the information generally is provided in large quantities. Therefore an appropriate selection of the information has to be done. There are several requirements as to how the presentation of the information is carried out. If the receiving station 1 is moveable, it is important that the presentation of information is such that it does not increase the risk of accidents occuring due to the driver loosing concentration while trying to get access to the information etc. Furthermore, since generally a lot of information is available, it must be easy to select the information that for the moment is the most relevant information as well as it is of importance to be able to quickly get an overview of the current situation in a given area.

According to the invention a message is illustrated as symbols, signs etc. which are overlaid a map display, e.g. a colour display. In the illustrated embodiment a particular symbol language is used for the first level of information. These symbols are somewhat more clearly illustrated in FIG. 4. Of course any other symbol language or similar can be used.

Figure 3A:
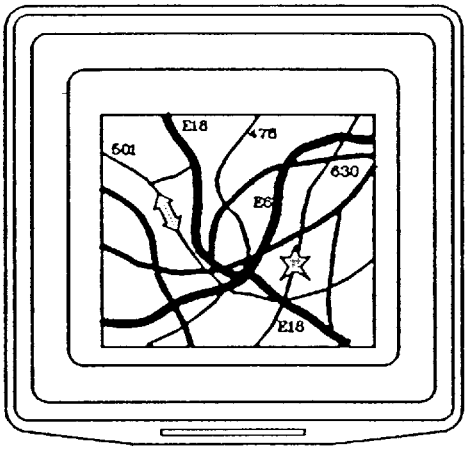
Figure 3B:
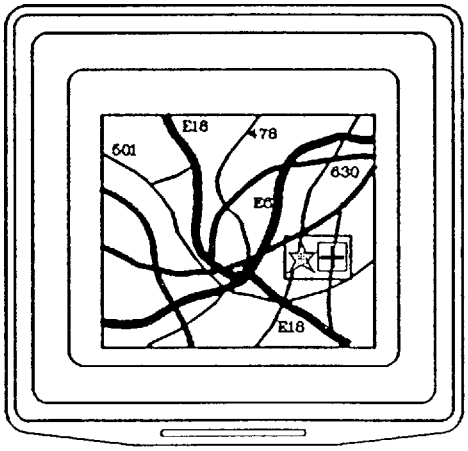
Figure 3C:
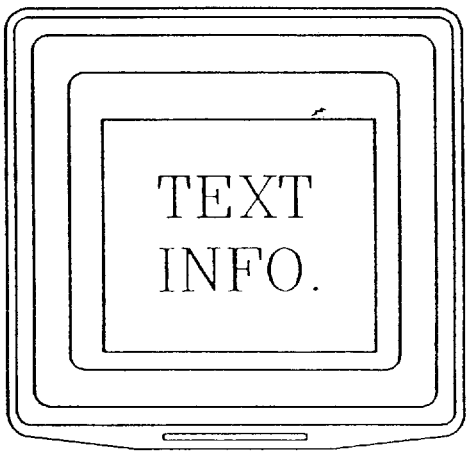

FIGS. 3A–3B illustrate three different information levels. In FIG. 3A merely symbols are shown, whereas in FIG. 3B a symbol and the corresponding traffic sign is shown, both within a frame within which no further symbol is shown. Preferably only one sign is shown. FIG. 3C relates to the most detailed information level, namely the text information. This will be further discussed later on.

At least a part of the basic or background information such as the map backgrounds, location codes, TMC message list in the desired language, icons etc. are stored on the exchangeable solid state memory card 2;2'. According to a preferred embodiment, essentially all fixed user and area dependent information is stored on an exchangeable memory card, whereas the transmitted and temporary information is stored (during a limited time interval) in a memory in the receiving station. This memory may e.g. be a EEPROM memory, but of course also other memories can be used. In FIG. 2 a block diagram illustrating the receiving arrangement is shown. The receiving arrangement is here described as comprising a runtime system, a tuner CPU, a display unit and a remote control unit all of which can be said to form part of the receiving station 1;1'. The memory card 2;2' forms part of the receiving arrangement 10;10' and in use, of course, also the memory card 2;2' has to be physically located at the receiving station 1;1'. However, an off-line system is used on the memory card 2;2' when its formed and loaded with information, i.e. in the datacard generation process. Map raw data is e.g. taken in as vector format files.

The vector map is then converted to a raster map. The output from the generation process is a raster format.

Icons and signs can e.g. be created using any appropriate method.

The definitions of location codes generally have to be agreed upon together with authorities or similar. Upon provision of the memory cards, it can be provided for access to or selection between a number of different languages, e.g. ten languages but also fewer or more. Generally location definition tables, message definition tables and optional message tables are provided for. Also system messages are preferably defined in an off-line process. This is schematically illustrated in FIG. 2.

The runtime system comprises a number of functional parts which have to fulfill a number of requirements such as tuner management, presentation management requirements, display management requirements, power supply management requirements, TMC decoder, presentation means and memory means requirements. The system generally comprises three main parts, namely the tuner CPU, the display CPU and the display. Different power situations of the main parts therefore are controlled by the power management. Particularly the system may operate in four different power modes. The tuner can according to the illustrated embodiment be run in four different modes namely normal mode, normal mode with preferred TMC network, a control mode and a send buffer content mode. In the normal mode, the tuner scans for the strongest TMC transmitter, in a normal mode with preferred TMC network, the tuner also scans for the strongest TMC transmitter and if more than one network is found, the tuner selects the preferred network.

Figure 6:
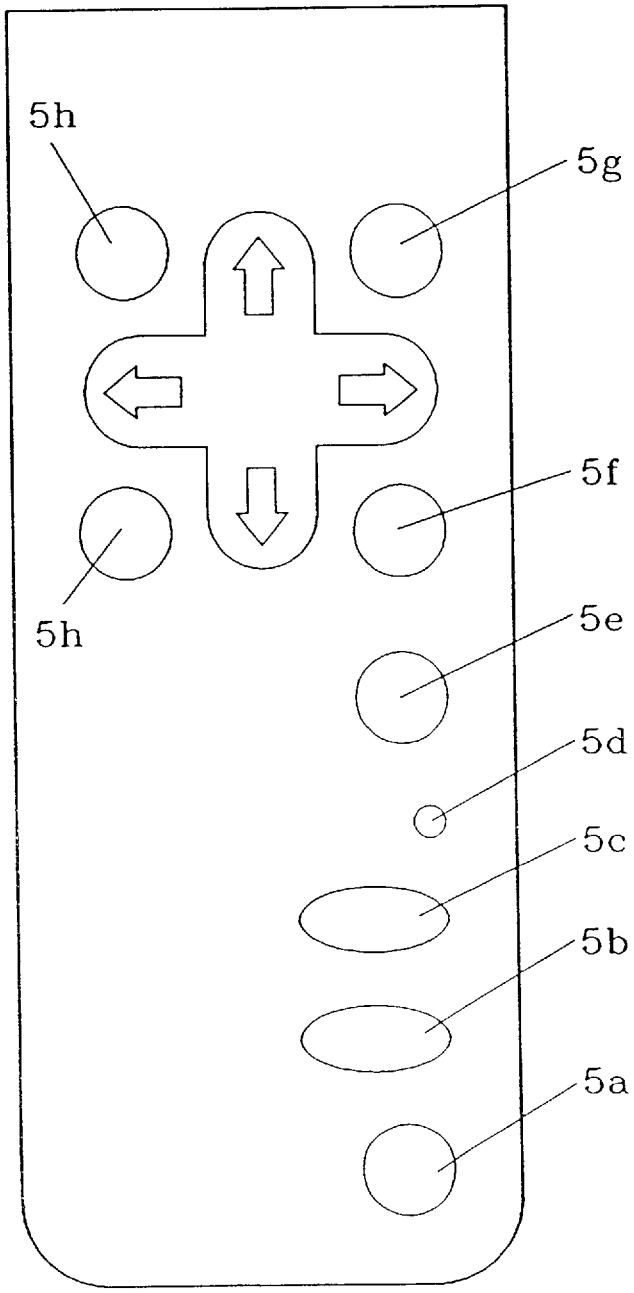
FIG. 6 illustrates a remote control unit and FIG. 7*a* illustrates signs of a filter setup menu.

The presentation manager is preferably operated with remote-control means e.g. the remote control unit 5;5*a*'. FIG. 6 gives an example of a remote control unit 5;5*a*' and the controlling thereof via buttons. In the shown embodiment the remote control unit 5;5*a*' only has symbols. In the case of a fixed receiver station 1', the remote control 5*a*' may be arranged on the receiving arrangement 10', thus not really forming a "remote" control. This is of course merely given as an example and a number of different embodiments are possible. The remote control unit 5;5*a*' is used for various functions. The button 5*a* is used for switching ON/OFF. HELP button 5*b* relates to help service where as HOME button 5*c* relates to the home area map. The SETUP button 5*d* relates to a setup mode for defining information levels via a filter function wheres the button denoted 5*e* relates to an information mode. MAP button 5*f* is used for the illustration of the map. Buttons 5*h*, 5*h*' are used for zooming out and in respectively and with the button 5*g*, FILTER, a particular filter configuration can be selected. With the controlling means having up, down, left and right arrows, that part of a map which the user is particularly interested in, can be picked out. In the system a predetermined number of information levels are available. In the illustrated embodiment there are three different levels. The first level or the lowest level comprises symbols as mentioned above. The second level relates e.g. to road signs and the third or the highest level is a text message wherein the message is displayed in normal text. In most cases the first level, i.e. the symbol level, is sufficient. The first level is the simplest level, and to get an overview of the situation it is generally sufficient with just a short glance on the map with the symbols, particularly during driving in case the receiving station 1 is moveable.

In an advantageous embodiment a HOME map is stored which automatically is shown in order to avoid having to search the appropriate map each time. Generally networks indicate different maps. The selection of the most relevant map also depends on degree of information that is needed.

Among others in order to avoid that the receiving arrangement 10;10' gets too complicated and complex to operate, which is of the utmost importance, it is decisive that there are not too many control-buttons.

Figure 5:
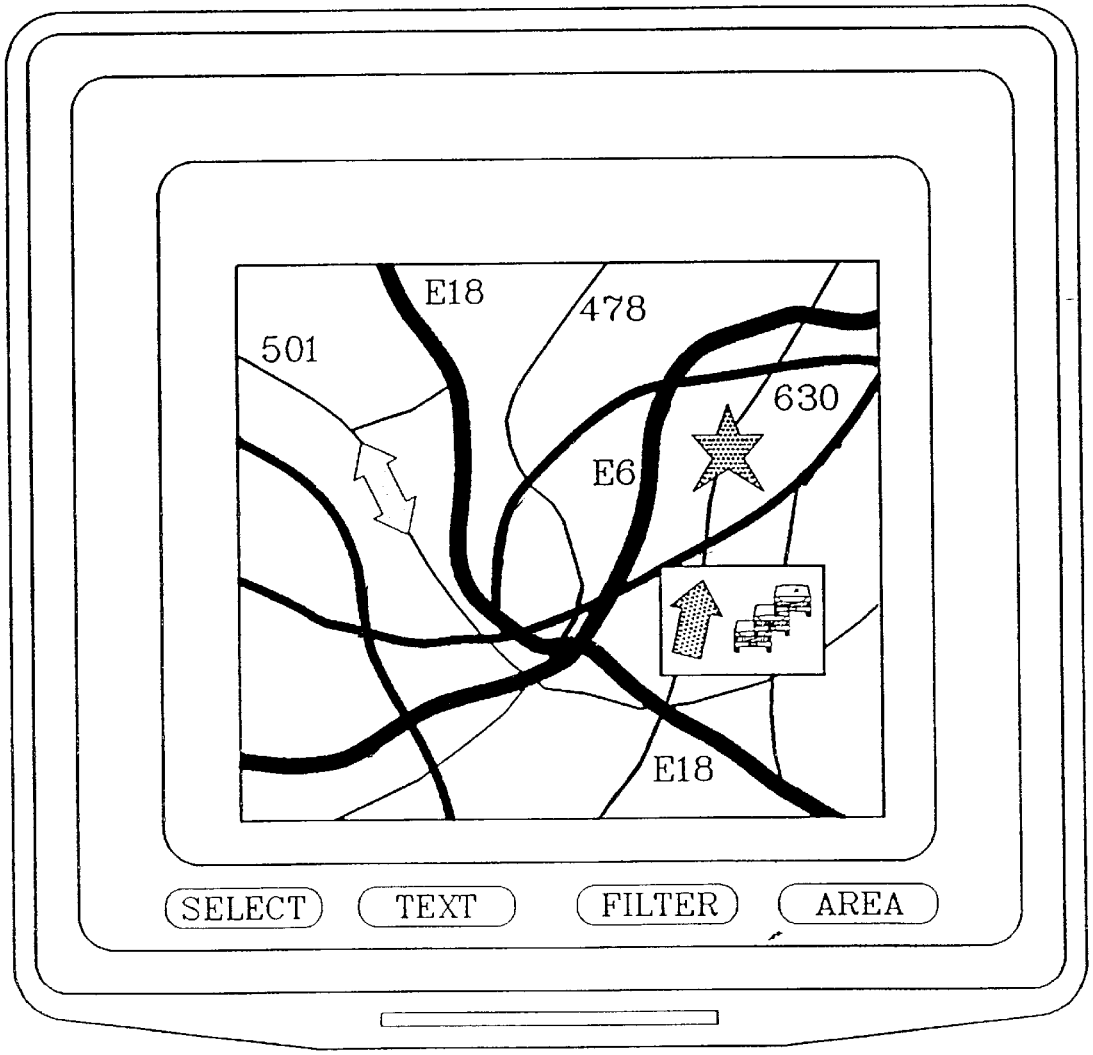
FIG. 5 illustrates an example of the display layout.

In another embodiment, there are four control buttons. This embodiment is shown in FIG. 5 which is a schematical view of the display means 3;3'. The four control-buttons are here the SELECT button, the TEXT button, the FILTER button and the AREA button. The SELECT button is used to select the message, one at a the time, in order of priority and time of arrival. When a message is selected, a surrounding border with the symbol and the additional sign e.g. a road sign for slippery road etc. will appear. If, however a message is to be selected in text form, the TEXT button is pressed and the full text of the message will appear on the display. The TEXT button is used for toggling between map and text mode.

With the AREA button it is possible to toggle between the available maps or message areas which are stored on the memory card. Messages which are valid for a region or an area that can not be put on a point location on the map will be indicated e.g. in the lower corner of the display as a small rectangle. According to one embodiment the small rectangle can be yellow or red depending on the urgency of the message. Of course other colours can also be chosen, different symbols for each urgency level etc.

When the button denoted FILTER is activated, a filter is introduced and all-non urgent messages, which according to a particular embodiment are yellow, will be removed. Therethrough it gets easier to identify the most urgent messages.

Figure 7A:
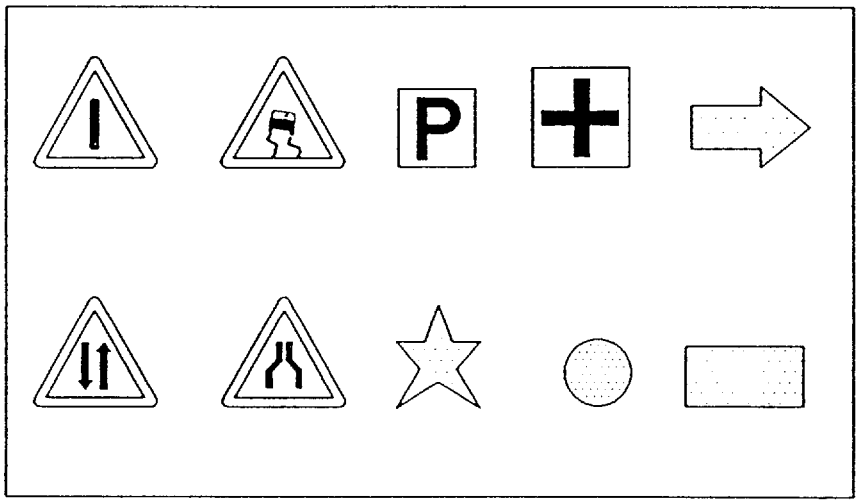
Figure 7B:
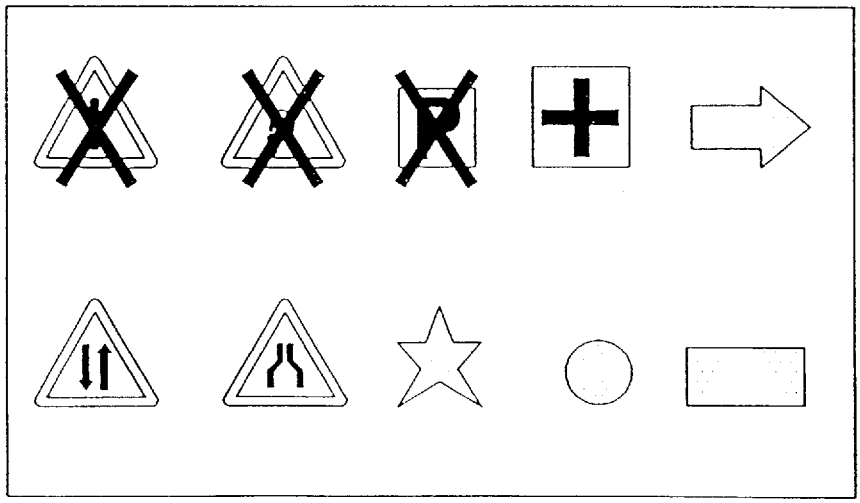
FIG. 7*b* illustrates how a particular filter can be defined and FIG. 8 schematically illustrates the system as linked to the Global Positioning System.

According to a particularly preferred embodiment it is a possible to define different filters or levels. This can in an advantageous embodiment be done with use of the remote control unit 5;5'. Therethrough it gets possible for each user to select the amount or kind of information which is most convenient to that particular user and the way in which it corresponds to a particular information level. Thus the user can define or program the receiver station via an adaptable filter function. Therethrough the number of symbols/signs as well as which signs are to be shown on the respective levels are defined; e.g. a particular user might not be interested in some particular kind of information; then the defines the level such that the corresponding symbol/sign/text does not occur on the display etc. In order to define or program an information level using the filtering function the Filter Setup function is activated e.g. via the remote control. A Filter Menu is then shown on the display, see e.g. FIG. 7*a*, comprising a number of signs, for example 12 different signs. Through crossing out one or more signs a filter corresponding thereto is defined. This means that these signs are not shown, neither as signs on the sign level or as symbols on the symbol level. If more detailed information is wanted, i.e. a user wants to change information level he finds the symbol (arrow) he is interest in, and the corresponding sign is shown together with the symbol, both within a common frame. There cannot be more than one symbol within a frame—otherwise it would be confusing and not clearly defined to which symbol a shown sign corresponds. In a preferred embodiment all other signs disappear from the frame.

It is an important issue of the invention that the user, particularly in the case of a driver, is not overwhelmed by technology i.e. that the system is too demanding to use. It is also an important issue that the quality of the information is high, i.e. that it is easy to find the appropriate level both generally and in a particular case. It is most important that the information arrives in due time and in that it accurately describes the situation and further that it disappears as soon as possible when the hindrance etc. has been removed.

There can also be a number of means for making the system easy to adapt to the subjective needs of the user. Via the filter setup menue it is possible to select and define the filter as already discussed above. This means that for each level, the symbols, signs, etc. that will correspond to the particular level can be chosen entirely by the user, the levels are thus not fixed but can be varied according to subjective needs. However, there may be a standard setup, and if the user does not have any particular wishes, this will be applied and shown.

According to one embodiment at least two different sizes on icons can be used such as a normal and a small. A button can be used for changing between the two sizes or a change related to the map scale e.g. automatically.

Figure 8:
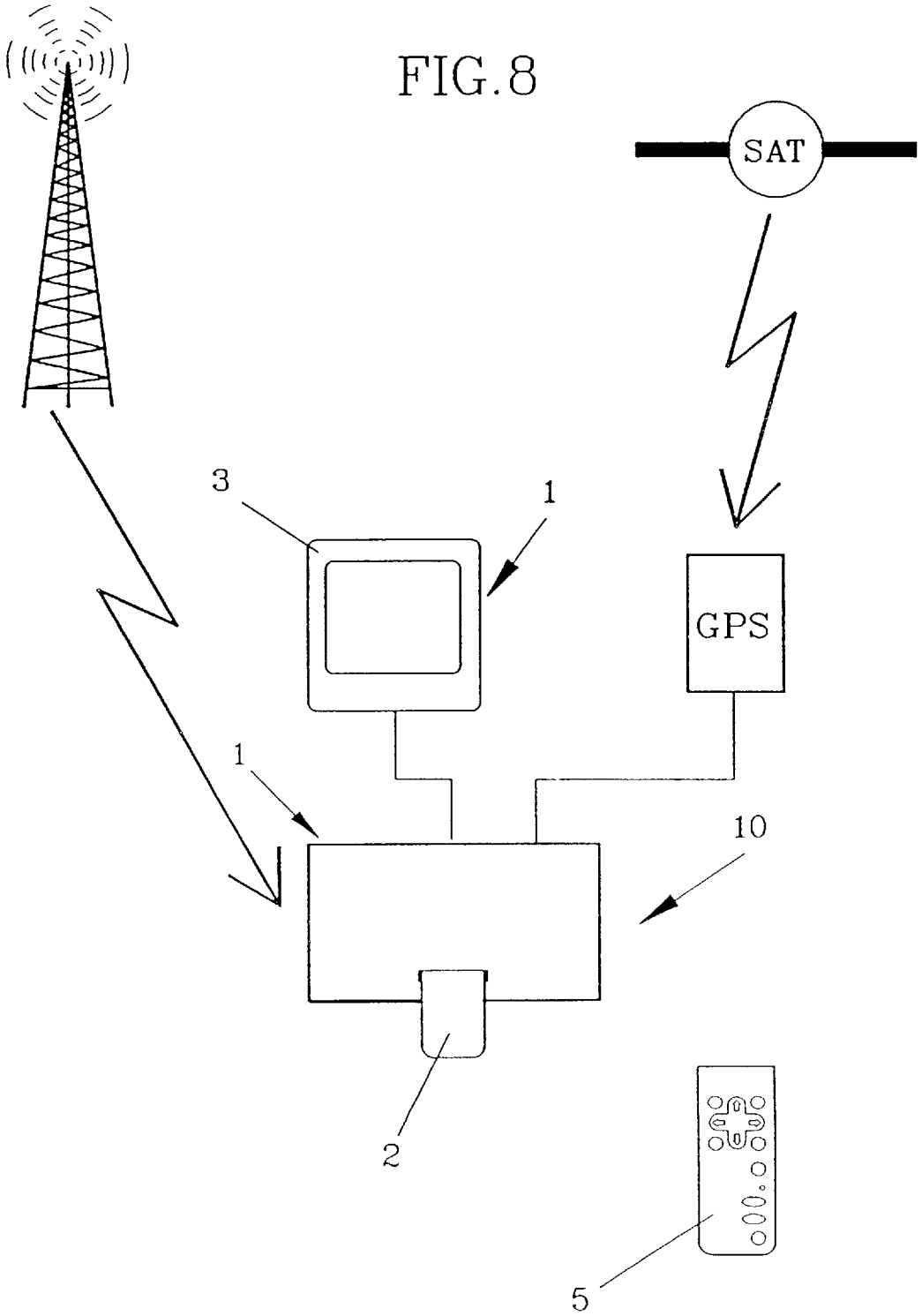

According to a particular embodiment the system is connected to a positioning system. An example (c.f. FIG. 8) is the Global Positioning System GPS. Therethrough it is possible to receive traffic information at the same time as the position of the moving vehicle can be illustrated on the display e.g. as a moving car or similar. The connection and disconnection of the connection to the positioning system can according to a particularly advantageous embodiment be done with e.g. the remote control unit and the function can be a function which can be selected through the function, e.g. it can be "filtered out" or not. With the application of a positioning system the map can be automatically changed to be the "right one" depending on where the car, i.e. the receiving station, actually is as it is moving. The changes from one picture to another or from one map to another are particularly discrete, the "map frames" are changed. Thus this may also be an optional function.

For security reasons the more advanced functions, particularly the text function, is not accessible when the vehicle is moving but it has to be stopped in order that access be admitted to this function.

According to one embodiment around 800 messages are available and the number of icons (symbols) as well as the number of traffic signs can be e.g. 10,20 or more. These values are of course merely given for exemplifying reasons. The invention can be varied in a number of ways and shall of course not be limited to the embodiments shown herein but merely by the scope of the appended claims.

I claim:

1. Traffic information system receiving traffic information from at least one primary traffic information center for providing traffic information to a receiving arrangement, said traffic information center further comprising coding and transmitting arrangements for transmitting coded, digital traffic information over a digital radio communication system to the receiving arrangement comprising a receiving station which comprises decoding and processing means for decoding and processing the coded, digital traffic information, presentation means for presentation of user input or the coded, digital traffic information, said receiver arrangement further comprising means storing basic or background information in relation to which the user input or coded, digital traffic information is presented, the means for storing at least part of the basic information being an exchangeable memory card, at least part of the basic information being optional with different detail levels relating to a range of most basic information to most detailed information wherein the different detail levels include symbols, traffic signs and text levels and in that control means are provided for subjectively defining the information to be shown via a programable filtering function through which a filter can be defined or programmed to select a detail level of the basic information.

2. Traffic information system according to claim 1, wherein the programmable filtering function is programmed from a Filter Setup menu shown on the display and on which can be indicated which information is to be displayed or not.

3. Traffic information system according to claim 1, wherein the digital radio communication system is RDS/TMS.

4. Traffic information system according to claim 1, wherein the means for presentation is a graphical display, a colour display or not.

5. Traffic information system according to claim 1, wherein the basic information stored on the memory card comprises a limited number of maps and location codes for connection to a code on a map.

6. Traffic information system according to claim 1, wherein the coded, digital traffic information include a traffic message list stored on the memory card in at least one optional language.

7. Traffic information system according to claim 1, wherein symbols or icons and/or traffic signs are stored on the memory card.

8. Traffic information system according to claim 7, wherein remote control means are used for setting or defining the desired information or display level that is automatically shown when the system is activated.

9. Traffic information system according to claim 7, wherein remote control means further can be used for zooming on a map.

10. Traffic information system according to claim 1, wherein all basic or background information is stored on the memory card whereas all transmitted user and area dependent traffic information is stored in a memory in the receiver station.

11. Traffic information system according to claim 1, wherein the different information levels include one of a selected one of symbols, traffic signs and text levels.

12. Traffic information system according to claim 1, wherein via an adaptable filter function, a subjective information level can be defined or programmed in such a way that symbols, signs, or text levels corresponding to information that is not desired, is/are not shown.

13. Traffic information system according to claim 12, wherein the adaptable filter function is defined or programmed by selecting one of symbols, signs, or text levels to be displayed.

14. Traffic information system according to claim 13, wherein the text level is only available when the receiving station does not move.

15. Traffic information system according to claim 1, wherein it is possible to select between at least two different palettes having different colours and light intensities.

16. Traffic information system according to claim 1, wherein it is linked to a positioning system so that both traffic information and the position of the receiving station is available at the same time.

17. Traffic information system according to claim 1, wherein the receiving station is located in a moveable unit such as a car or similar.

18. Traffic information system according to claim 1, wherein the receiving station is arranged in a fixed unit or that it is stationary.

19. Method for providing traffic information wherein a primary traffic information center comprises or collects traffic information, the traffic information center selects the information to be transmitted, the traffic center codes and transmits digital traffic information via a digital radio communication system to a receiving arrangement comprising a receiving station wherein the receiving station provides for decoding and processing of user input information or the coded, digital traffic information, the receiving arrangement further including memory means for storing basic or background information, the user input information or the coded, digital traffic information being connected to or superposed on the basic or background data on the memory means; and presentation means displaying the the coded, digital traffic information superposed on the basic information, at least an essential part of the basic or background information, with basic information having different detail levels relating to a range of most basic information to most detailed wherein the different detail levels include symbols, traffic signs and text levels, said information being located on a memory card which is exchangeable, said memory card being connected directly or indirectly to the receiver station, and in that a filtering function can be selected through which a Filter Setup menu is shown on the display so that a user can choose which information to be displayed.

20. Method according to claim 19, wherein the available information comprises different levels including one of a selected one of symbols, traffic signs and text levels.

* * * * *